United States Patent [19]

Kopp

[11] Patent Number: 4,461,483

[45] Date of Patent: Jul. 24, 1984

[54] GAME APPARATUS EMPLOYING CARDS AND DICE

[76] Inventor: Warner Kopp, 1 Pleasant Valley Rd., Mendham, N.J. 07945

[21] Appl. No.: 432,132

[22] Filed: Sep. 30, 1982

[51] Int. Cl.[3] ..... A63F 3/00

[52] U.S. Cl. ..... 273/265; 273/148 R; 273/293

[58] Field of Search ..... 273/265, 269, 292

[56] References Cited

U.S. PATENT DOCUMENTS

| | | | |
|---|---|---|---|
| 2,560,187 | 7/1951 | Post | 273/303 X |
| 3,126,205 | 3/1964 | Jordan | 273/273 |
| 3,549,150 | 12/1970 | Weeks | 273/269 |
| 4,059,274 | 11/1977 | Samson | 273/265 |
| 4,222,565 | 9/1980 | Berrebi | 273/265 X |

FOREIGN PATENT DOCUMENTS

| | | | |
|---|---|---|---|
| 478690 | 10/1975 | Australia | 273/265 |

*Primary Examiner*—Harland S. Skogquist
*Attorney, Agent, or Firm*—Richard N. Miller

[57] ABSTRACT

A game apparatus for two players is disclosed comprising (A) a card tray containing at least N compartments; (B) N dice cubes, each cube bearing six different indicia on its faces and being of a different color from the other dice cubes; (C) 6N playing cards, each card having a single indicia corresponding to one of the dice indicia thereon, with N cards exhibiting the same indicia; (D) $N^2$ colored cards, each card being of a single color corresponding to one of the colors of said dice cubes, with N cards being of the same color; and (E) a holder for at least N dice cubes. Preferred embodiments include a card tray having N compartments on one side and N+1 compartments on the reverse side, dice cubes having one to six spots thereon which are located in the central portion of the card and color cards having a central cutout therein through which the indicia on an indicia card located below the color card in the card tray may be ascertained. Optional scoring cards may be included in the game apparatus which may serve as an educational game where braille characters are used as the indicia.

13 Claims, 9 Drawing Figures

GAME APPARATUS EMPLOYING CARDS AND DICE

The present invention relates to a game apparatus employing cards and dice, and more particularly to a game apparatus wherein colored dice are used by one player to form a secret code which is reproduced by the second player using a combination of cards bearing indicia corresponding to the indicia on the dice and color cards.

BACKGROUND OF THE INVENTION

Cards and dice have been used in combination in a large variety of games which have provided amusement and enjoyment to the public for many years. Sometimes such games have served to educate the public, too.

In one type of prior art game the cards and dice are used together with a board and the dice and cards are employed to advance a playing piece around the board. In further variations of the cards, dice and board game, the elements on the dice are coordinated with elements on the cards as in the game described in U.S. Pat. No. 3,614,105 for example. In another type of prior art game, the cards and dice are coordinated, but the board is omitted. A game of the latter type is shown in U.S. Pat. No. 2,560,187 for example. In each of the foregoing types of games, play typically is controlled by rolling the dice.

SUMMARY OF THE INVENTION

In accordance with the present invention a novel game apparatus is provided which is similar to the prior art games wherein the elements of the cards and dice are coordinated. However, unlike the prior art games, the inventive game is not controlled by rolling the dice. In the inventive game, one player arranges the dice in a holder to define a secret code based upon the color and elements on the dice and the second player plays to duplicate the secret code by depositing cards bearing dice elements thereon and color cards in a multi-compartment tray.

As indicated above, the inventive game apparatus for two players comprises (A) a card tray containing at least N compartments; (B) N dice cubes, each cube bearing six different indicia on its faces and being of a different color from the other dice cubes; (C) 6N playing cards, each card having a single indicia corresponding to one of the dice indicia thereon, with N cards exhibiting the same indicia; (D) $N^2$ color cards, each card being of a single color corresponding to one of the colors of said dice cubes, with N cards being of the same color; and (E) a holder for at least N dice cubes.

In one preferred embodiment of the inventive game apparatus, the card tray contains four card compartments on one side and five card compartments on the reverse side; the indicia on the dice are one, two, three, four, five and six spots usually found on dice and the spots are located in the central portion of the card; each said color contains a central cutout of a size through which the indicia on an indicia card located below the color card in the card tray may be ascertained; and the apparatus optionally includes scoring cards of a single color which is different from the colors of the color cards to facilitate scoring and each of these cards preferably contains a cutout in the central portion thereof of a size such that the indicia on an indicia card located below said scoring card in the card tray and a portion of a color card located below said scoring card in the card tray may be viewed through such cutout.

In a second preferred embodiment, the indicia on the dice cubes and dice cards of the preferred embodiment will be distinctively marked so as to be identifiable by a blind person so that the game may be played by blind persons. Color cards also will be distinctively marked so as to be identifiable by a blind person. In one variation of this latter embodiment, the indicia and distinctive markings will be braille characters which are raised so that the game may be played by either blind or blindfolded persons. In the latter instances, the game will be educational as well as entertaining.

BRIEF DESCRIPTION OF THE DRAWINGS

One preferred form of the game apparatus of this invention is illustrated in the accompanying drawings in which.

DETAILED DESCRIPTION OF THE INVENTION

Figure 1:
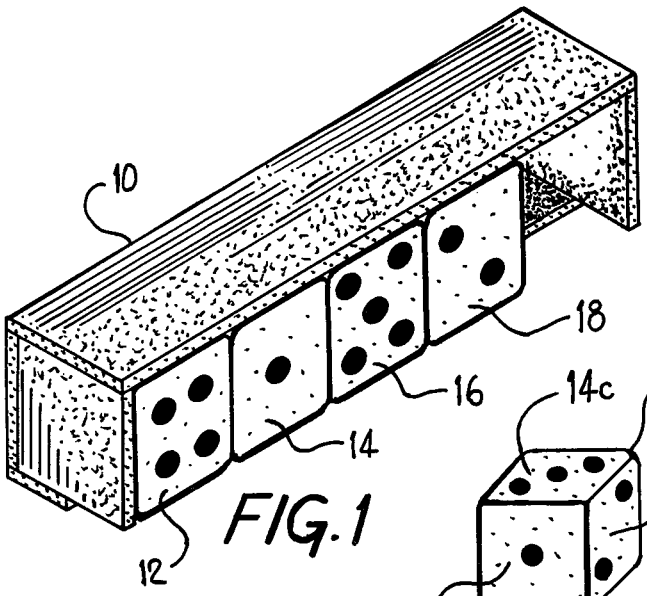
FIG. 1 is a perspective view of a code box or holder with four dice cubes therein depicting the hidden code formulated by the code maker.

Referring to FIG. 1, there is shown a dice holder 10 for five dice cubes and four differently colored dice cubes 12, 14, 16 and 18 located within holder 10. Dice holder 10 is essentially a box with an open side to display the code, but having its bottom of a lesser width than the two ends so that the dice cubes will protrude slightly for easier insertion and removal. Usually, holder 10 will be made completely of an opaque material so that the code to be formulated will be readily apparent to the code maker, but not visible to the code breaker.

Figure 2:
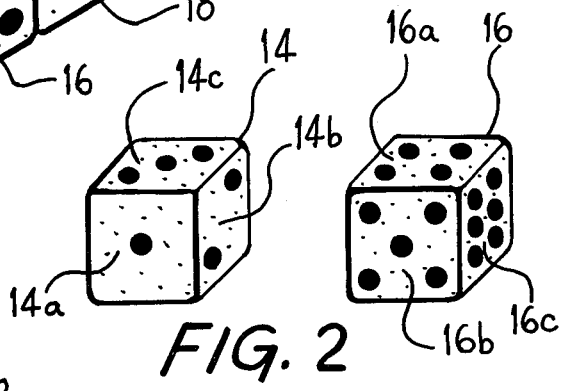
FIG. 2 is a perspective view of two dice cubes having one, two, three, four, five and six spots thereon which are used to formulate the code.

As shown in FIG. 2 wherein dice cubes 14 and 16 are depicted for illustration, each of the faces of dice cubes 14 and 16 has indicia thereon in the form of one spot 14*a*, two spots 14*b*, three spots 14*c*, four spots 16*a*, five spots 16*b* and six spots 16*c*. The number of dice cubes employed in the illustration embodiment is four, but might be five, and the colors of the cubes are such that 12 is blue, 14 is green, 16 is red and 18 is yellow.

Figure 3:
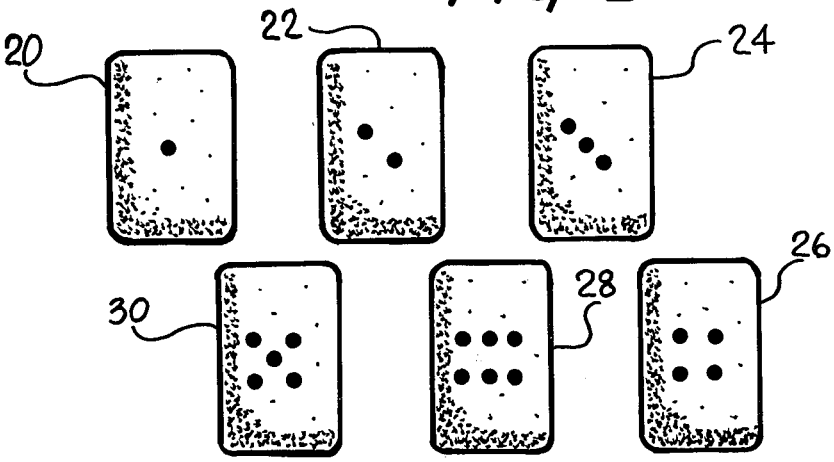
FIG. 3 is a plan view of typical dice cards utilized in the preferred form of the invention.

The indicia on the faces of dice members 12, 14, 16 and 18 correlate to the indicia shown on indicia cards 20, 22, 24, 26, 28 and 30 shown in FIG. 3. The number of indicia cards employed for each die is 6 as shown in FIG. 3 and, therefore, there will be 6N dice cards so that there will be one indicia card for each face of the four dice cubes 12, 14, 16 and 18. In the depicted dice cards, the indicia are located in the central portion of each card for a purpose which will be described subsequently.

Figure 4:
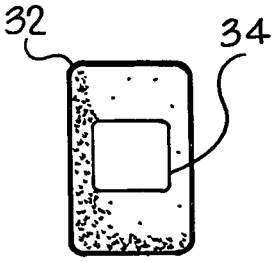
FIG. 4 is a plan view of typical color cards with a centrally located cutout utilized in the preferred form of the invention.

In FIG. 4, a single color card 32 is shown. The number of cards of each color will correspond to the number of dice N, i.e., four herein, and, thus, the total number of color cards will be $N^2$ or 16 in the preferred embodiment illustrated. Each color card 32 contains a cutout 34 in the central portion of the card in order that the indicia cards 20, 22, 24, 26, 28 and 30 may be ascertained when a color card 32 is placed on top of one of said indicia cards in card tray 40.

Figure 5:
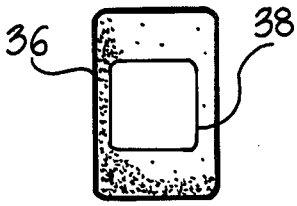
FIG. 5 is a plan view of a typical scoring or marker card with a center cutout which may be used to facilitate scoring.

FIG. 5 shows an optional scoring card 36 which is of a different color than the colors of dice cubes 12, 14, 16 and 18. Usually, the scoring card 36 will be either white or black. As with the color card 32, the scoring card 36 contains a cutout in the central portion which is sized so that the indicia of an indicia card and the color of a color card may be ascertained when scoring card 36 is placed on top of at least one dice card topped by at least one color card in card tray 40. The number of scoring cards 32 corresponds to the number of dice N, i.e., four herein. Use of the scoring cards is optional as is the employment of the cutout therein.

Figure 6:
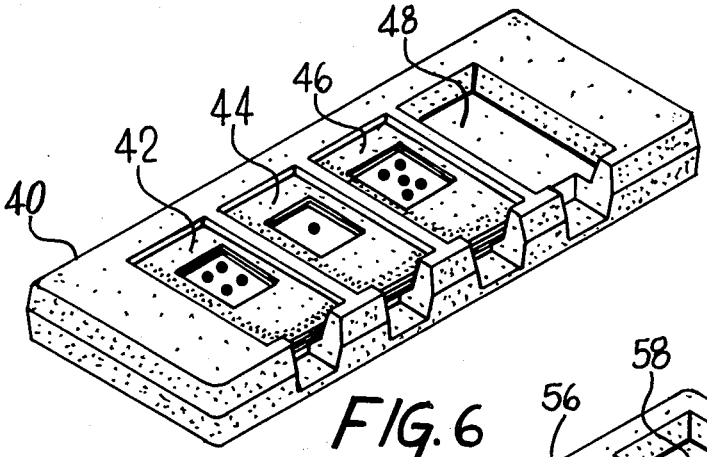
FIG. 6 is a perspective view of a four compartment card tray containing dice cards in four compartments which are covered by color cards and blank scoring cards in three compartments which duplicate part of the code shown in FIG. 1.
Figure 7:
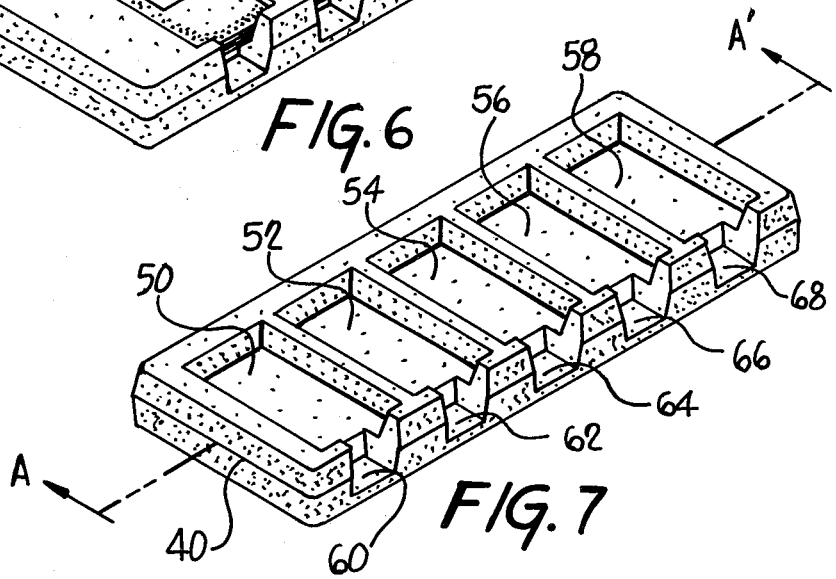
FIG. 7 is a perspective view of the five compartment card tray on the reverse side of the four compartment card tray shown in FIG. 6.
Figure 8:
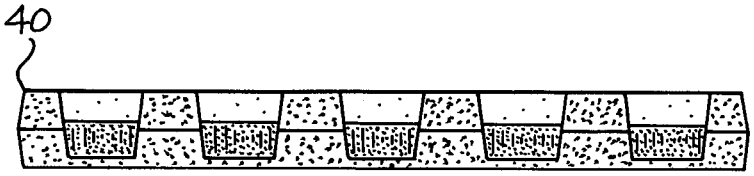
FIG. 8 is a front view of the card tray of FIG. 7.
Figure 9:
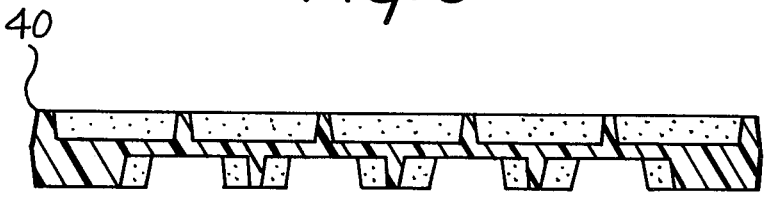
FIG. 9 is a cross section of the card tray of FIGS. 6 and 7 taken on line A—A′ of FIG. 7.

FIGS. 6–9 show a novel and particularly useful card tray 40 for use with the game apparatus. As shown in FIG. 6, card tray 40 contains four compartments 42, 44, 46 and 48 which are sized to hold a plurality of indicia cards 20 and color cards 32 as well as a scoring card 36. More specifically, each of compartments 42, 44 and 46 contains at least one dice card and at least one color card as well as a scoring card. FIG. 7 shows that the reverse side of card tray 40 contains five card compartments 50, 52, 54, 56 and 58 which correspond in size to compartments 42, 44, 46 and 48. Additionally, FIG. 7 shows the finger openings 60, 62, 64, 66 and 68 at the front of each card compartment. FIGS. 8 and 9 provide additional details of the construction of the novel, reversible card tray 40.

In order to play the game using the preferred game apparatus shown in FIGS. 1–9, the first player or code maker places dice cubes 12, 14, 16 and 18 in holder 10 to form a secret or hidden code based upon the indicia and colors of the dice cubes. Referring to FIG. 1, the hidden code consists of the number 4 on green die 12, the number one on yellow die 14, the number 5 on blue die 16 and the number 2 on red die 18. The second player or code breaker attempts to duplicate the code by playing indicia cards and color cards in sequence in each of the compartments 42, 44, 46 and 48 in card tray 40. When the code breaker places a card in the compartment, the code maker will say "no" if the card does not match the indicia or color as the case may be and will say "yes" when a match is made. After the code breaker matches the indicia in the first compartment, he proceeds to deposit color cards in that compartment. Again, when the green color card is placed in compartment 42, the code maker confirms that the color is correct by saying "yes." At the point, the code breaker places a scoring card--a white card--of the type shown in FIG. 5 in compartment 42 and the cutout therein makes the number on the dice card and a portion of the color on the color card visible. Player two then proceeds in a similar manner to duplicate the numbers and colors of the next three die members of the hidden code in compartments 44, 46 and 48. After the code is duplicated, the score is determined by counting the number of cards played before breaking the code, with dice cards counting one and color cards counting 3 or 5, for example. At this juncture, the roles of the players are reversed, with the second player becoming the code maker and the first player becoming the code breaker. The player having the lowest score of the two games may be declared the winner or, alternatively, the player having the lowest score after four to ten or twenty games may be declared the winner.

If the indicia on the dice cubes and the dice cards of the preferred embodiment are projected above the surface so as to be ascertainable by touching and the color cards are identified by cutouts on an edge, e.g., one notch signifies blue, two notches signifies green, etc., the game may be played by two blind persons or by two blindfolded persons. Furthermore, if the raised indicia on the dice cubes and dice cards consisted of braille alphabet letters or numbers and the color cards were identified by raised braille letters b, g, r and y, the resultant game could be used to teach two blindfolded players the braille alphabet and numbers and entertain them as well.

While the game has been described using four dice cubes, it is obvious that five dice cubes could be employed--holder 10 has space for five dice cubes--in conjunction with the five compartment card tray of FIG. 7. Of course, the fifth dice cube would have to be of a different color, e.g., orange, and then the number of dice cards would be increased by 6 to 30, i.e., 6N, and the number of color cards would be increased by 9 to 25, i.e., $N^2$.

In a more complex version of the latter game, the code maker could have the option not to employ the fifth die, thereby leaving one compartment of the holder blank. Such option obviously makes it more difficult for the code breaker to duplicate the hidden code and tends to increase scores.

In an even more complex version, the game could contain more than five different color dice cubes, e.g., seven. In this version only five of the seven different color cubes would be used by the code maker while the two unused color cubes would be kept out of sight to the code breaker. The code breaker would have a choice of seven different color cards to duplicate a hidden code of only five dice cubes. Naturally, the number of color cards of each color would have to correspond to the total number of different colored dice. This version would increase the complexity of the game without increasing the present size of the dice holder and card tray or the number of dice cards.

Although the game has been illustrated with four or five dice cubes, it should be apparent that it could be simplified for small children by reducing the number of dice cubes to three or could be further complicated for adults by increasing the number of dice cubes to six or eight. Of course, the size of the dice holder and the card tray also would have to be increased in corresponding fashion.

The design of the various elements of the game apparatus, likewise, is not critical. For example, the card tray may contain from three to eight compartments and have the compartments on one side only as opposed to being reversible. The dimensions of the compartments will be based upon the dimensions of the cards. Desirably, however, the card tray will include finger openings of the type shown in the drawings to facilitate insertion and removal of the dice cards and color cards. Similarly, the design of the dice holder is variable so long as the design is such that the hidden code can be kept from view of the opposing player, but be readily ascertainable and disclosable at the end of the game. Advantageously, the design should be adapted to permit easy insertion and removal of each individual dice cube such as the recessed bottom of holder 10. Another suitable design would be to extend the top and the ends of the described dice holder beyond the end of the dice and to introduce finger openings in the back which would then become the bottom of the alternative holder. In the latter design, the code would face upward, but could not be seen by the code breaker because of the extended side and ends.

In addition to variations in the indicia, e.g., one to six spots, arabic letters, braille alphabet letters or numbers, etc., on the dice members and dice cards, the position of the indicia on the face of each die and each card is variable. More specifically, the indicia may be in the same plane as the surface or project from the surface or may be indented in the surface. Raised indicia are particularly suitable where the game is to be played by blind persons or by blindfolded persons. Furthermore, in a game for the blind, the dice cubes may be of different sizes, with each size representing a particular color. Similarly, in games for the blind, colored cards could have differently shaped cutouts such as round, triangular, square, hexagonal, etc., to represent different colors.

Although the inventive game apparatus has been described with respect to certain preferred and alternative embodiments, it should be understood that such embodiments are for purposes of illustration only and do not limit the scope of the invention.

What is claimed is:

1. A game apparatus for two players comprising (A) a card tray containing at least N compartments; (B) N dice cubes, each cube bearing six different indicia on its faces and being of a different color from the other dice cubes; (C) 6N playing cards, each card having a single indicia corresponding to one of the dice indicia thereon, with N cards exhibiting the same indicia; (D) $N^2$ colored cards, each card being of a single color corresponding to one of the colors of said dice cubes, with N cards being of the same color; and (E) a holder for at least N dice cubes, N being a whole number of at least three.

2. Game apparatus according to claim 1 wherein said card tray contains N compartments on one side and N+1 compartments on the reverse side of said tray.

3. Game apparatus according to claim 1 which includes, in addition, N scoring cards of a single color which is different from the colors represented in the colored cards.

4. Game apparatus according to claim 2 wherein N is four and the indicia on the dice cubes are one, two, three, four, five and six spots.

5. Game apparatus according to claim 4 wherein said indicia are centrally located on said indicia cards and each said color card contains a centrally located cutout through which said indicia on said indicia card may be ascertained when said indicia card is located below said color card in the card tray.

6. Game apparatus according to claim 5 wherein N scoring cards of a single color different from the colors represented in the color cards are included, in addition, to facilitate scoring, each said scoring card having a centrally located cutout therein of a size that the indicia on an indicia card located below said scoring card in said card tray and a portion of a color card located below said scoring card in said card tray may be viewed through said cutout.

7. Game apparatus according to claim 2 wherein said dice cubes, said indicia cards and said color cards bear distinctive markings thereon which will be identifiable by a blind person or a blindfolded person.

8. Game apparatus according to claim 7 wherein said distinctive markings are achieved by embossing or indenting particular marks thereon.

9. Game apparatus according to claim 7 wherein said indicia on said dice cubes are one, two, three, four, five and six spots which are embossed on each face of the cube and said distinctive markings on said indicia cards are achieved by perforations.

10. Game apparatus according to claim 9 wherein said distinctive markings on said color cards are achieved with edge markings, said indicia cards contain said indicia in the central portion of each card and each said color card contains a centrally located cutout through which said indicia on an indicia card located below said color card in said card tray may be ascertained.

11. Game apparatus according to claim 10 which further includes N scoring cards of a single color different from the colors represented in the color cards, in addition, to facilitate scoring, each said scoring card having a centrally located cutout therein through which the indicia on an indicia card located below said scoring card in said card tray and a portion of a color card located below said scoring card in said card tray may be viewed.

12. Game apparatus according to claim 8 wherein said distinctive markings are embossed braille characters.

13. Game apparatus according to claim 1 wherein N is a whole number from three to eight.

* * * * *